United States Patent [19]

Kennedy

[11] 4,021,613

[45] May 3, 1977

[54] AUDIO INFORMATION MODIFYING APPARATUS

[76] Inventor: Clive Kennedy, 13 E. 63rd St., New York, N.Y. 10021

[22] Filed: June 9, 1975

[21] Appl. No.: 585,133

[52] U.S. Cl. ..... 179/1 D; 179/1 M
[51] Int. Cl.[2] ..... G10H 5/00
[58] Field of Search ..... 179/1 D, 1 J, 1 M

[56] References Cited

UNITED STATES PATENTS

| | | | |
|---|---|---|---|
| 3,624,266 | 11/1971 | Sharp | 179/1 J |
| 3,795,770 | 3/1974 | Kato | 179/1 J |
| 3,803,359 | 3/1974 | Corderman | 179/1 D |
| 3,842,204 | 10/1974 | Leslie | 179/1 J |

*Primary Examiner*—William C. Cooper
*Assistant Examiner*—E. S. Kemeny
*Attorney, Agent, or Firm*—Robert D. Farkas

[57] ABSTRACT

An apparatus which modifies sound by introducing selected levels of clipping, sustaining, tone generation, echo effects, phasing effects, and suppression of low and high frequency signals to the input to a conventional audio amplifier thereby producing pleasing and interesting sound.

7 Claims, 3 Drawing Figures

AUDIO INFORMATION MODIFYING APPARATUS

BACKGROUND OF THE INVENTION

1. The Field of the Invention

This invention relates to entertainment and recreational devices in general and more specifically to sound created by instruments and voice.

2. Description of the Prior Art

Heretofore, sound produced by musical instruments such as a guitar, organ or the human voice were modified by passing the electrical equivalent to the produced sounds through an electrical distortion free audio amplifier. Should a different form of distortion be desired, substitution of the electrically distorted mechanism to the desired distortion producing mechanism was required. Alternately, some equipments permit a number of distortion devices to operate concurrently but use the input electrical sound equivalent to feed the input of each distortion device while the output of each distortion device is connected in parallel before being fed to the input of an audio amplifier.

SUMMARY OF THE INVENTION

An audio tone signal modifier comprised of sequential distortion devices acting upon the audio input signal used to modify the input audio signal prior to the introduction of said signal into the input of an audio amplifier.

A primary object of the instant invention is to provide an audio tone modifying device constructed to produce pleasing and interesting variations from the audio signal presented to the input thereto.

Another object is to provide a means of selectively operating different modes of distortion at the will of the user.

Still another object is to provide an apparatus capable of passing an audio signal without distortion or modification.

A further object is to provide an apparatus which can be conveniently operated by the use of foot switches which control the mode of distortion selected by the user.

DESCRIPTION OF THE PREFERRED EMBODIMENT

The structure and method of fabrication of the present invention is applicable to an apparatus modifying audio tones into an electrical signal which can selectively faithfully reproduce the input audio tone or in varying degrees introduce controlled and selected sequential distortions to the input signal. The output of the apparatus is introduced into the input of an audio amplifier. The sequence of tonal distortion is to first clip or limit the amplitude of the input signal, and to provide a sustaining affect. A tone generating device follows sequentially which adds higher and lower frequencies to its input. A gradually attenuating or amplified echo effect modifies sequentially the signal and the signal thus produced is fed into a phase inverted feedback path having decaying amplitude feedback. The output signal is then fed to a high pass and low pass filter device which is used to attenuate the extremes of the audio band of frequencies.

Figure 1:
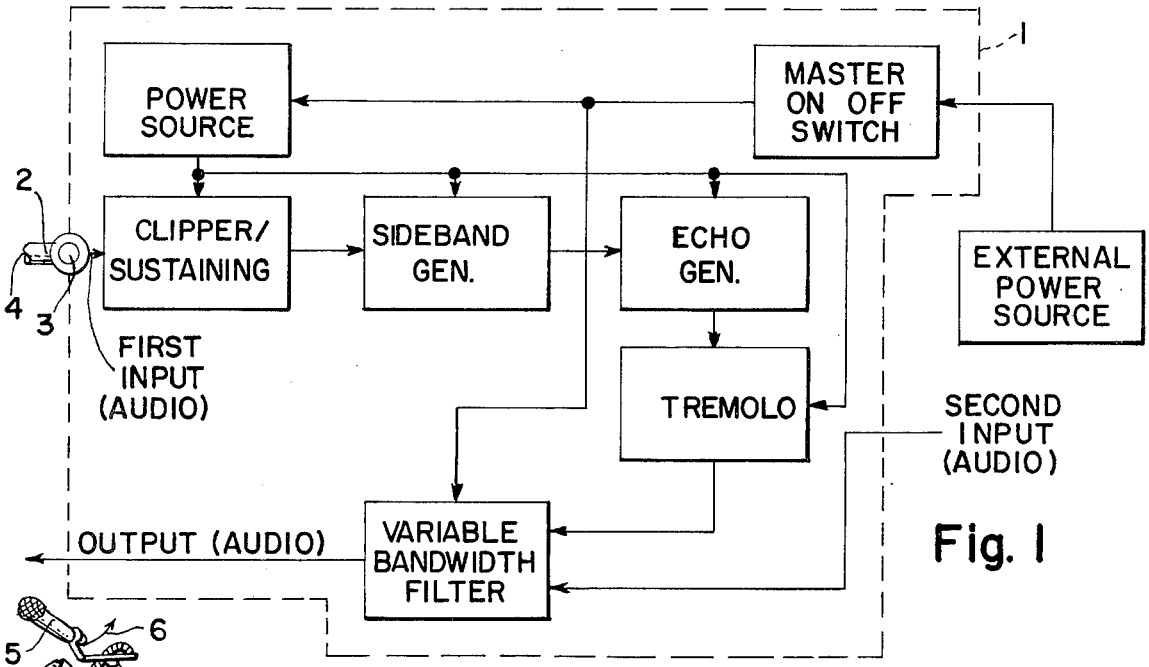
FIG. 1 is a block diagram representation of the function of the various circuits and devices employed.

Now referring to the Figures, and more particularly to the embodiment illustrated in FIG. 1 illustrating the block diagram of the apparatus as to the function of each distortion element and as to their interconnections. The composite apparatus 1 is comprised of a hollow tube 2 which transmits an audio tone introduced at the open end 4 to a microphone 3 detachably mounted to the apparatus. The microphone 3, when detached, may be employed directly without the use of tube 2. Electrical energy is supplied by an external power source, such as line voltage of 110 volts alternating current which is in turn fed to a master on-off power line switch. The line voltage is permitted, when the master switch is closed, to connect to and provide line energy to a power source, which can be utilized to modify the line voltage to suitable voltage levels supplying energizing power to the first, second, third, fourth and fifth distortion elements represented by blocks. The audio sound introduced to the microphone 3 is converted into an electrical signal and fed to the input of the first distortion circuit. This circuit produces a fuzzy-like effect by clipping or limiting the amplitude of the voltage introduced at its input. A sustaining or continuing affect to each note, tone or word is created by a positive feedback circuit adjusted to conditions of near self-oscillation. The voltage produced by the first distortion circuit is fed to the input terminals of the second distortion circuit which adds new information to its input by the use of a ring modulator circuit and which is fed by a local oscillator and the signal produced by the first distortion circuit. The output of the second distortion circuit contains the sum and difference frequencies of the local oscillator and the input signal as well as the input signal itself. The second distortion circuit may be described as a double sideband and carrier signal. The circuit is arranged such that the carrier may be suppressed or either of the sidebands may be suppressed or combinations of sideband and carrier suppression may be obtained. When both sidebands or the sum and difference frequencies are fully suppressed without suppressing the carrier, the second distortion circuit will simply pass its input signal without distortion or the introduction of additional distortion tones. The output of the second distortion circuit is fed into the input of the third distortion circuit comprised of circuitry and devices capable of producing an attenuating echo effect. Variable delay between sequential echo-like sounds and constantly attenuating each sequential echo-like sound creates the effect of music or voice being played and repercussed in a large room or chamber. This effect can be obtained by the use of an endless magnetic tape driven by an electrical motor at variable speeds. The input to this distortion circuit is recorded onto the tape by a suitable magnetic recording head. A pickup head detects the presence of the recorded information some fixed distance away from the recording head. The speed at which the tape progresses and/or the distance between the heads determines the time delay between recording and pickup of the recorded information. Thus, varying the speed of the tape shortens or lengthens the time interval required to transverse the information recorded on the tape between the recording and pickup heads. The recorded information may be completely eliminated by an erase head immediately preceeding the introduction of that information back into the recording head. Alternately, the recorded information may be partially eliminated to ever increasing degrees on each pass through the erase head. The effect of no erasure gradually through to full erasure over a sustained period of time permits a gradual decay in each repeated pass through the pickup head. The effect created is similar to the decaying sounds for each sequential echo following a burst of sound in an echo chamber. A control is provided to variably select either the rate of decay or the rate of the ability to amplify successively each echo-like sound recorded on the tape. This amplifying affect creates echoes which increase rather than decrease in amplitude, in a gradual fashion. The output of a third distortion circuit is connected to the fourth distortion circuit. This circuit is comprised of a conventional distortion free amplifying stage having a negative feedback path connecting output to input. The amount of feedback is varied gradually creating a low frequency variation of the signal introduced at the input to the fourth distortion circuit. The fourth distortion output circuit is connected to the fifth distortion circuit input and, if desired, an additional auxiliary audio input is fed to an input of the fifth distortion circuit. The fifth distortion circuit modifies its input signal by variably and selectively attenuating the high end and the low end frequencies of the audio range for each signal introduced to it. Mixing of both signals occurs within the fifth distortion circuit. Circuits comprised of a high frequency band stop filter in conjunction with a low frequency band to stop filter or alternatively high and low frequency band pass filters may be used to suppress those tones appearing near the extremes of the audio range. The effect created is to attenuate the treble or base tones or in a neutral condition to permit the input signal to pass through without attenuation. A volume control limits the level of voltage appearing at the output of the fifth distortion circuit to control the voltage amplitude of a composite modified signal produced by the entire apparatus before it is permitted to be connected to the input of a conventional audio amplifier and speaker system.

Figure 2:
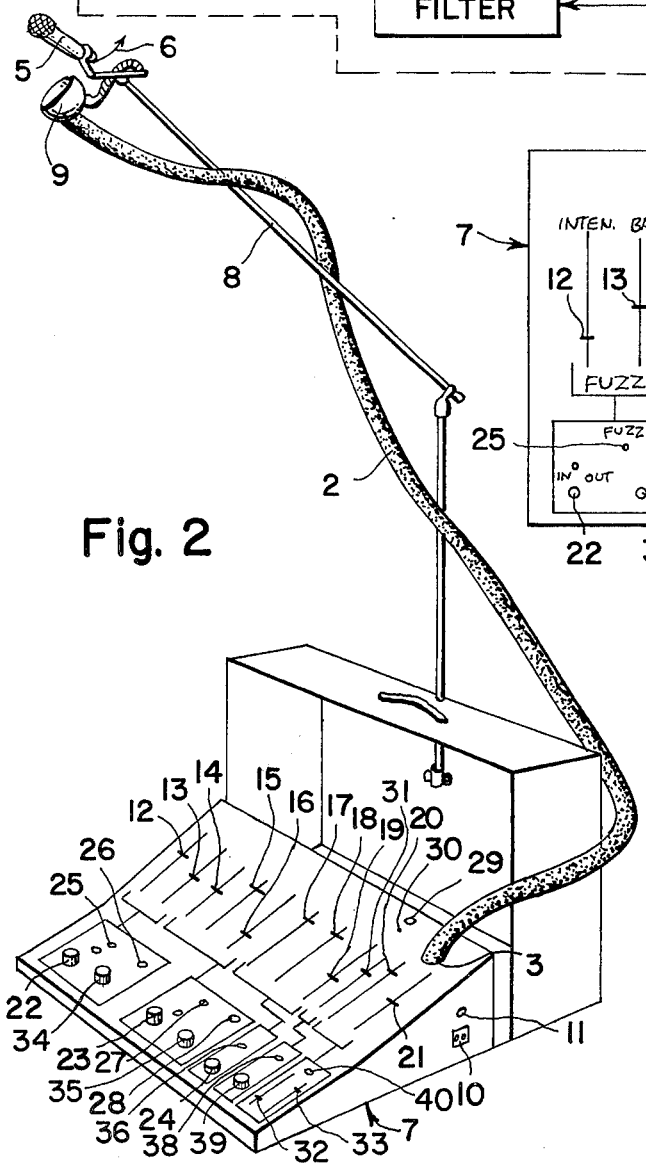
FIG. 2 is a perspective view of the apparatus including a control panel.

FIG. 2 depicts an embodiment of the present invention illustrating a microphone 5 connected directly to the input of a conventional audio amplifier not shown at the point 6. A hollow flexible tube 2 is supported by the microphone 5 supporting stand 8 and terminates at the free end in a sound pickup opening 9 having an open area larger than the internal cross sectional area of the tube 2. The sound introduced into the tube proceeds through it to a microphone 3 which can be fastened to the control panel 7. Line power is introduced through the use of an external flexible line cable, not shown, feeding an appropriate socket 10. The output of the sound modifier is connected to an output socket at 11 and is connected through a flexible cable not shown to an input terminal of an audio amplifier and speaker system not shown. A second audio input signal may be introduced at terminals 40.

Figure 3:
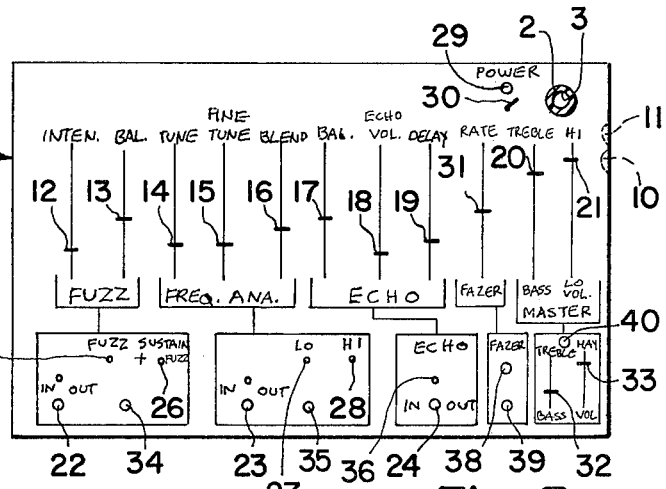
FIG. 3 is a plan view of the control panel illustrating the labelling and markings thereon.

FIG. 3 illustrates the markings as well as the function of the controls mounted to the control panel 7. Slide controls are illustrated by numbers 12, 13, 14, 15, 16, 17, 18, 19, 20, 21, 31, 32 and 33. 12 and 13 constitute control elements of the first distortion circuit wherein the slide control 12 selects the degree of the clipping or limiting level. Slide control 13 controls the amount of feedback thus creating a variable degree of continuance or sustaining sound. The section depicted by the bracket entitled Frequencies Analyzer is comprised of controls 14, 15 and 16 and are the control elements of the second sound distortion circuit. Control elements 14 and 15 select or suppress the sidebands. Control element 16 selects alternatively variably the input signal to the second distortion circuit and the sidebands output levels permitted to pass by the settings of controls 14 and 15. Control numbers 17, 18 and 19 comprise the controls of the third distortion circuit and entitled Echo. Control element 17 selects between the intensity of the echo-like sounds produced within the third distortion circuit and the input signal to the third distortion circuit. Control element 19 controls the time rate of attenuation or amplification of the echo sounds from no attenuation for each successive sound to a rapid rate of attenuation such that only one or a part of one echo may be heard. Control element 18 selects echo-like sound decaying or increasing in amplitude. Control element 31 controls the rate of the effect created by the fourth phasing distortion circuit. Control elements 20, 21, 32 and 33 comprise the variable controls of a fifth distortion circuit. Control element 20 selects the degree of attenuation of high or low frequencies of the signal at the output of the fourth distortion circuit. Control element 21 is utilized to control the amplitude of the fourth distortion output signal fed to the output socket 11. Similarly, control elements 32 and 33 control the frequency selective attenuation and amplitude of the auxiliary input signal. Mixing of the output signal from the fourth distortion circuit and the modified auxiliary input signal occurs within the fifth distortion circuit. Foot switches 22, 23, and 24 control, respectively, the overall function of the first, second and third distortion circuits. Each foot switch has an accompanying pilot light indicating, when lit, the functional use of the associated circuit. Additionally, pilot lights 25 and 26 light in variable intensities indicating, respectively, the degree of clipping and sustaining effects produced. Pilot lights 27 and 28, respectively, indicate the variable intensity light at the presence of the sum and difference frequencies. Pilot light 29 indicates the presence of line voltage within the apparatus by closure of the on-off light switch 30.

Foot switch 34 selects the clipping effect alone or the combined effect of clipping and tone sustaining effects created by positive feedback in the first distortion circuit. Foot switch 35 used in the second distortion circuit, selects either the difference or the sum and difference frequencies. Pilot light 36 indicates the activation of the third distortion circuit. Pilot light 38 indicates the operational status of the fourth distortion circuit. Foot switch 39 controls the activation of the fourth distortion circuit.

One of the advantages of the combination and sequence of distortion devices is to provide pleasing and interesting sounds created from the audio signals presented at the input of the device.

A further advantage lies in the convenient manner in which each distortion device may be utilized to varying degrees in the sequential manner elected.

Still another advantage is obtained when each distortion circuit is disabled or controlled to pass the signal without creating distortions.

A further advantage includes the ability of the user to control modes of operation by the use of the user's feet.

Thus, there is disclosed in the above description and in the drawings embodiments of the invention which fully and effectively accomplish the objects thereof. However, it will be apparent, to those skilled in the art, how to make variations and modifications to the instant invention. Therefore, this invention is to be limited not by the specific disclosure herein, but only by the appending claims.

The embodiments of the invention in which an exclusive privilege or property is claimed are defined as follows:

1. An audio information modifier comprising first audio input terminals connected to a series circuit of first distortion means connecting to a second distortion means connected to a third distortion means connected to a fourth distortion means connected to a first input of a fifth distortion means, second audio input terminals connected to the second input terminals of said fifth distortion means, said fifth distortion means comprised of output terminals adapted to provide modified audio information voltages compatible with the input voltage levels required to drive a conventional linear audio amplifier without further distortion by said audio amplifier, said first, second, third and fourth distortion means each adapted with independent manual control elements operable to select desired magnitudes of voltage distortion affecting audio information introduced to said first audio input terminals, said fifth distortion means adapted with independent manual control elements operable to select desired magnitudes of voltage distortion affecting audio information present at said first and second input terminals of said fifth distortion means, said first distortion means comprised of amplitude clipping means and a positive voltage feedback path connected between the output and input of said amplitude clipping means, said second distortion means comprised of a local oscillator and a ring modulator circuit producing voltages which are sideband information in the form of sum and difference frequencies added to the signal distortion means, said third distortion means comprised of a memory storage echo device adapted to speedily retrieve signal information thus stored variably delayed in time and increasingly attenuated in amplitude with each cycle of retrieval, said fourth distortion means comprised of a negative feedback circuit connected from output to input of said fourth distortion means, having gradual cyclic variations in the amplitude of feedback, said fifth distortion means comprised of frequency selective attenuating circuitry suppressing the audio signals passing through said fifth distortion means utilizing high and low frequency attenuating filters.

2. The audio information modifier of claim 1 further comprising a manual selective control affecting the magnitude of the signal, passing through said fifth distortion means, emanating from said first and second input terminals of said fifth distortion means.

3. The audio information modifier of claim 1 further comprising a voltage dividing circuit variably manually attenuating the amplitude of audio information appearing at said fifth distortion means output terminals, controlling the input signals introduced at said first and second input terminals of said fifth distortion means.

4. The audio information modifier apparatus of claim 1 contained within a unitary container.

5. The audio information modifier of claim 1 further comprising individually foot operated switches manually selectively eliminating the introduced distortion of said first, second, third and fourth distortion means permitting audio information to undistortedly pass through said first, second, third and fourth distortion means.

6. The audio information modifier of claim 1, further comprising manual controls affecting the audio signal introduced at said second input terminals of said fifth distortion means by modifying the amplitude and linearity of frequency response.

7. The audio information modifier of claim 1 further comprising means to add together audio voltages present at said first and second input terminals within said fifth distortion means.

* * * * *